US005099254A

United States Patent [19]

Tsukii et al.

[11] Patent Number: 5,099,254

[45] Date of Patent: Mar. 24, 1992

[54] MODULAR TRANSMITTER AND ANTENNA ARRAY SYSTEM

[75] Inventors: Toshikazu Tsukii, Santa Barbara; William A. Allard, Goleta, both of Calif.

[73] Assignee: Raytheon Company, Lexington, Mass.

[21] Appl. No.: 497,949

[22] Filed: Mar. 22, 1990

[51] Int. Cl.[5] ..... H01Q 23/00

[52] U.S. Cl. ..... 343/853; 333/247; 361/382; 361/393; 361/395; 342/368

[58] Field of Search ..... 361/392-394, 361/399, 400, 382; 174/52.3, 52.5; 343/700 MS, 700 R, 701, 853; 342/368, 371-373; 333/247

[56] References Cited

U.S. PATENT DOCUMENTS

| | | | |
|---|---|---|---|
| 2,889,493 | 6/1959 | Scal et al. | 361/394 |
| 2,942,856 | 6/1960 | Woodward et al. | 361/382 X |
| 3,329,959 | 7/1967 | Laub et al. | 343/796 |
| 3,345,631 | 10/1967 | Chamberlin, Jr. | 342/372 |
| 3,508,269 | 4/1970 | Snyder | 343/701 |
| 3,541,559 | 11/1970 | Evans | 343/756 |
| 3,549,949 | 12/1970 | Granberry | 361/393 X |
| 3,648,113 | 3/1972 | Rathjen et al. | 361/382 X |
| 3,706,010 | 12/1972 | Laermer et al. | 361/394 X |
| 4,001,834 | 1/1977 | Smith | 343/754 |
| 4,081,803 | 3/1978 | Dempsey | 343/795 |
| 4,297,711 | 10/1981 | Ekstrom | 343/794 |
| 4,353,072 | 10/1982 | Monser | 343/725 |
| 4,527,165 | 7/1985 | de Ronde | 343/778 |
| 4,641,145 | 2/1987 | Rammos | 343/798 |
| 4,771,294 | 9/1988 | Wasilousky | 343/853 |
| 4,829,314 | 5/1989 | Barbier et al. | 343/778 |
| 4,879,630 | 11/1989 | Boucard et al. | 361/394 X |
| 4,884,168 | 11/1989 | August et al. | 361/382 |

FOREIGN PATENT DOCUMENTS

| | | | |
|---|---|---|---|
| 67701 | 4/1984 | Japan | 343/700 R |

OTHER PUBLICATIONS

Allen, John L.; "Phased Arrays-There is a Future", *The Microwave Journal*, 4th Microwave Journal Seminar; 21 Mar. 1965; pp. 108-116.

Taylor, T. H. et al.; "Multi-Beam Communications Phased Array Element Control Module"; *27th Electronic Components Conf.;* 16-18 May 1977, Arlington, Va.; U.S.A.; pp 336-338.

Bandy, G. C., et al.; "MERA Modules-How Good in an Array?"; *Microwaves;* vol. 8, No. 8; Aug. 1969; pp. 39-49.

Mailloux, R. et al.; "Microstrip Array Technology"; *IEEE Trans. on Ant. and Propogation;* vol. AP-29, No. 1; Jan. 1981; pp. 25-37.

Kinzel, J. and Rees, D.; "V-Band, Space-Based Phased Arrays"; *Microwave Journal;* Jan. 1987; pp. 89-102.

*Primary Examiner*—Eugene R. LaRoche
*Assistant Examiner*—Benny T. Lee
*Attorney, Agent, or Firm*—Richard M. Sharkansky

[57] ABSTRACT

A module for constructing a modular transmitter is disclosed. The module contains antenna elements along the front edge of a base. RF circuitry is fabricated on both the top and the bottom sides of the base. The base contains heat pipes to carry heat away from RF circuitry. The base is made to be plugged into a mounting block which provides electrical signals to the module and acts as a sink for the heat removed by the heat pipes.

24 Claims, 4 Drawing Sheets

MODULAR TRANSMITTER AND ANTENNA ARRAY SYSTEM

The Government has rights to this invention pursuant to Contract No. N00019-87-C-0086 awarded by the Department of the Navy.

BACKGROUND OF THE INVENTION

This invention relates generally to systems transmitting radio frequency signals and more particularly to electronic modules which can be assembled into a transmitter with a phased array antenna.

In many types of radio frequency (RF) systems, phased array antennas are used. For example, radars, direction finders and radios all can use phased array antennas. Some of these systems use one dimensional arrays while others use two dimensional arrays. Additionally, the number of elements in an array can vary from relatively few, say four, to a large number, say hundreds of elements. The size and shape of the array dictates the shape of the beam transmitted by the antenna. (Throughout, antennas will be referred to as transmitting signals, but one of skill in the art will appreciate that antennas are equally applicable to receiving signals.) Thus, the size and shape of an antenna array is derived from the requirements of the system in which it is used. It follows, therefore, that the size and shape of the transmitter needed to drive all the elements in the array is also dictated by the requirements of the system.

Under current design practice, when a system is defined, the system architecture is determined and the appropriate size and shape of an antenna is computed. A housing is then designed which holds the required number of array elements and electronics for the transmitter such as amplifiers, phase shifters, phase shifter controllers, RF signal paths, and DC bias distribution networks. Also, the housing often incorporates some mechanism to remove the heat produced by the electronics to avoid overheating of the electronics.

A manufacturer must complete a new design effort each time a new system with a different size antenna array is required. This design effort can be costly and time consuming.

SUMMARY OF THE INVENTION

With the foregoing background in mind, it is an object of this invention to provide transmitter modules which can be assembled into a transmitter with a linear or two dimensional phased array antenna.

It is an object of this invention to provide a module incorporating antennas and phase shifters which can be assembled into a radio frequency transmitter.

It is also an object to provide an apparatus which allows a quick and low-cost design of a transmitter.

It is further an object of this invention to provide a structure for removing heat generated by a plurality of modules containing electronic components.

The foregoing and other objects are achieved by a module comprising a plurality of dual polarization antenna elements. The antenna elements are mounted along one edge of a base. An amplifier and a phase shifter for each antenna element are mounted on the top surface of the base. These electronic components feed the co-polarization input of the antenna elements. Similar electronic components are mounted on the bottom surface of the base. These components feed the cross-polarization input of the antenna elements. The thickness of the electronic components plus the thickness of the base is less than the height of the antenna elements and the width of the electronic components is less than the width of the antenna elements.

The base and antenna elements of the module are adapted such that the module can be placed next to, either in a horizontal or vertical direction, other like modules.

To remove heat generated by the electronic components, the base of the module contains a plurality of heat pipes, with one heat pipe disposed adjacent each of the electronic components. Each heat pipe terminates at a tab in one edge of the module. The tab fits into a slot in a mounting block to which the modules are attached. The mounting block contains a channel carrying cooling fluid, into which the slot projects. RF and DC signals are coupled to the module through the mounting block.

BRIEF DESCRIPTION OF THE DRAWINGS

The invention may be better understood by reference to the following more detailed description and accompanying drawings in which.

DESCRIPTION OF THE PREFERRED EMBODIMENTS

Figure 1A:
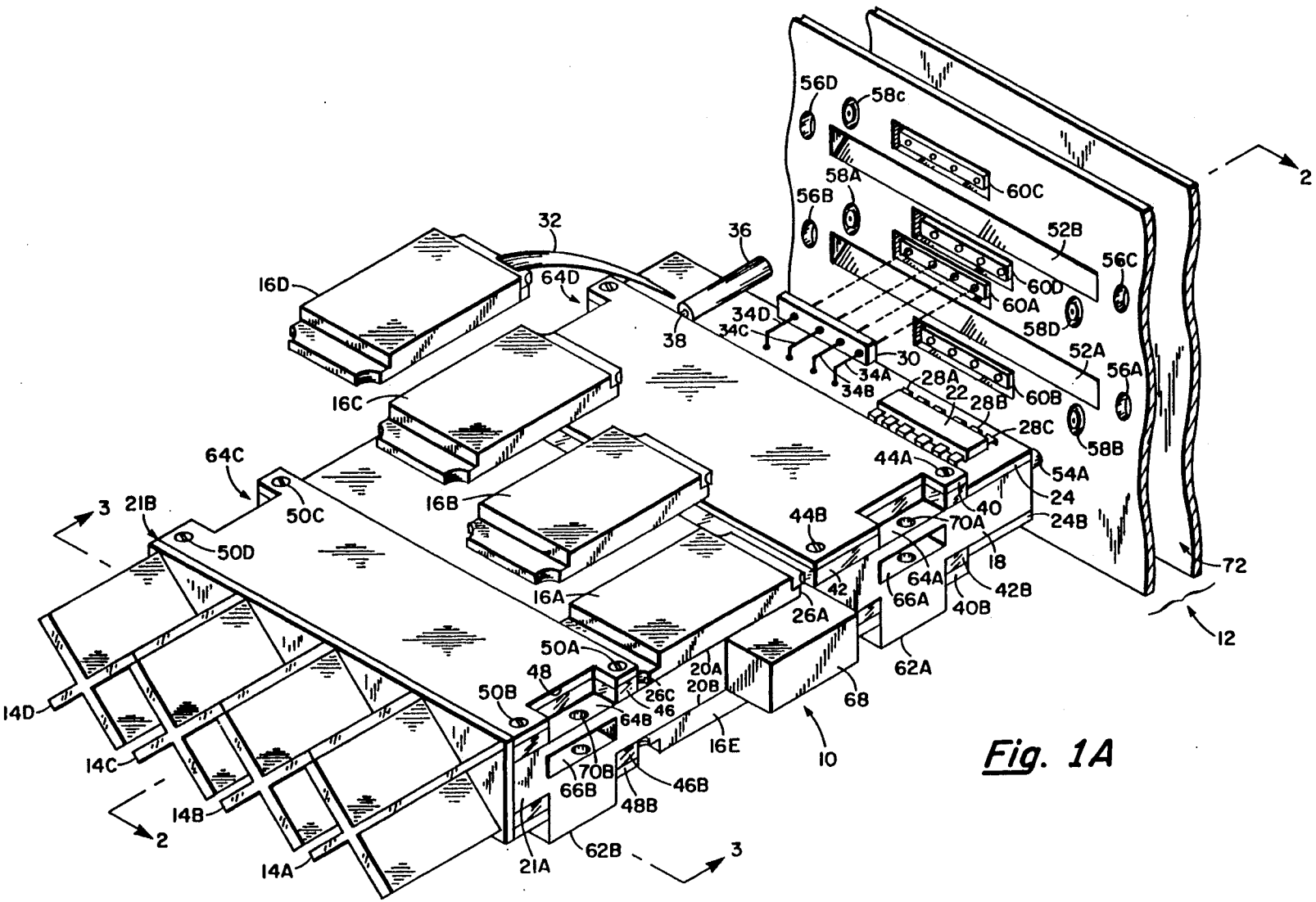
FIG. 1A is an isometric view of a module and a section of a mounting block constructed according to the present invention.
Figure 1B:
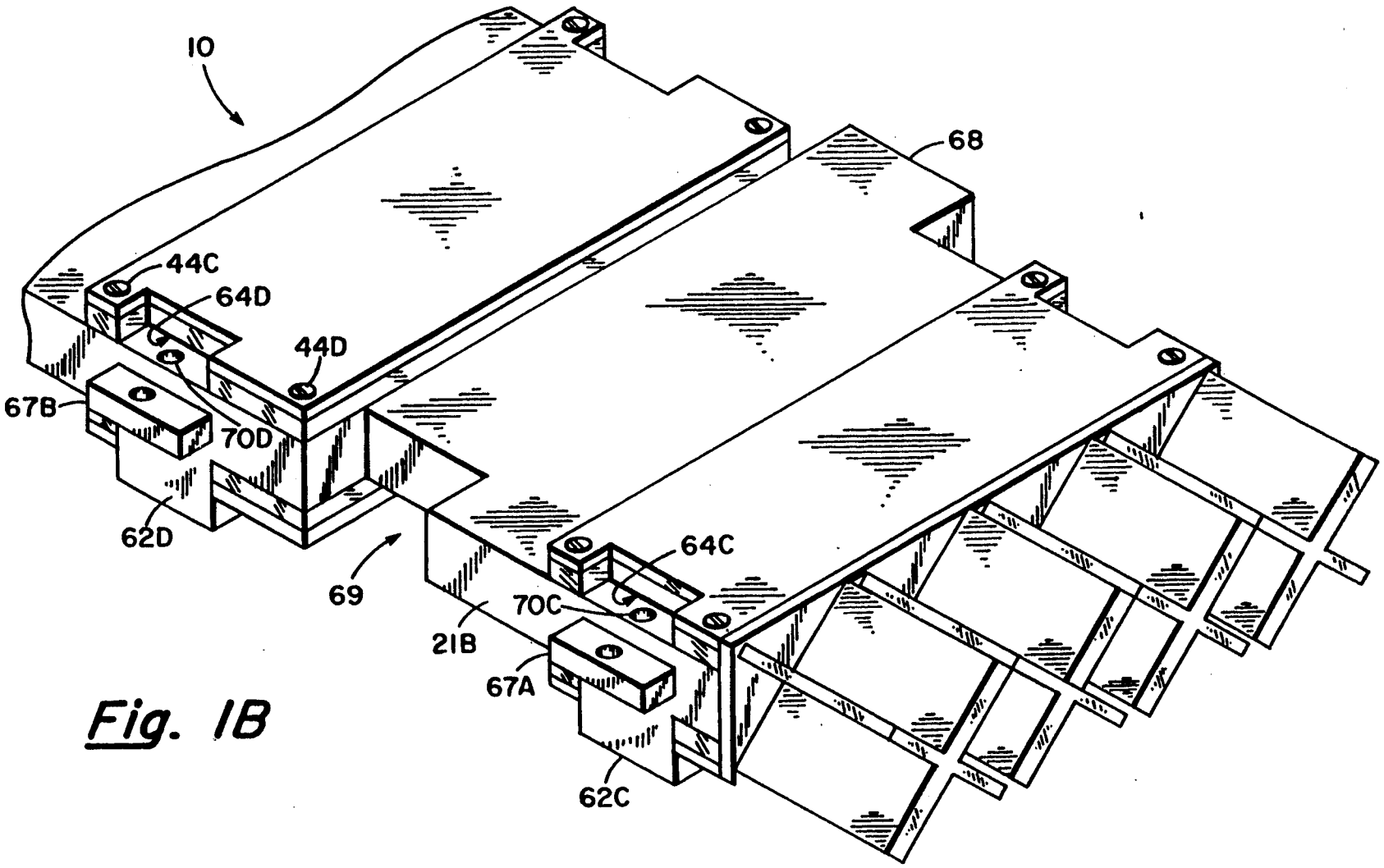
FIG. 1B is an isometric view of the module of FIG. 1A oriented to reveal the side obscured in FIG. 1A.

FIG. 1 shows a transmitter module 10. This module contains a plurality of antenna elements 14*a* . . . 14*d*. Here, antenna elements 14*a* . . . 14*d* are arranged in a 4×1 antenna array. The module 10 is adapted for attachment to a mounting block 12. In a system, other like modules would also be attached to mounting block 12 to provide an antenna array of the desired size. For example, to provide a transmitter with 16×2 antenna array, three like modules would be plugged into the mounting block 12 in a chain next to module 10 to form one row of 16 elements. Another layer of four like modules would be plugged into the mounting block 12 above the first row of elements to complete the 16×2 array.

Antenna elements 14*a* . . . 14*d* are here dual polarization elements. Each transmits a co-polarization and a cross-polarization signal. The antenna elements 14*a* . . . 14*d* are constructed in any known manner. For example, gold plated copper traces etched on a substrate made of a dielectric material, such as that sold under the trade name Duroid® could be used to form the antenna elements 14*a* . . . 14*d*.

Module 10 contains a base 18. Base 18 provides structural support for module 10 and must also be thermally conductive. The base 18 also acts as a ground plane and must be electrically conductive. Thus, base 10 is preferably fabricated from a metal such as aluminum.

As seen in FIG. 1, base 18 serves as a mounting point for the antenna elements 14*a* . . . 14*d*. In addition, RF circuitry and control logic circuitry is mounted to base 18. RF packages 16*a* . . . 16*d* contain RF circuitry such as amplifiers and phase shifters. One of skill in the art will appreciate what circuitry is required to drive each antenna element in a phased array antenna. RF packages 16*a* . . . 16*d* are mounted on the upper surface of base 18. Four other similar RF packages are mounted on the lower surface of base 18, but, with the exception of RF package 16*e*, the packages on the lower surface of base 18 are not visible in FIG. 1.

RF packages 16*a* . . . 16*d* are mounted to the upper surface of base 18 using screws (not shown). Each of the RF packages has four mounting recesses such as mounting recesses 26*a* . . . 26*c* (only three numbered for illustration). The shaft of a screw (not shown) can be placed in the mounting recess and then screwed into base 18. The head of the screw overlaps the RF package, thereby securing it. With RF packages 16*a* . . . 16*d* mounted adjacent to each other, the mounting recesses of the adjacent packages will be adjacent such that one screw can be used to secure two packages.

Logic chip 22 is also mounted on the upper surface of base 18. Logic chip 22 contains control logic to be described in greater detail below. Here, logic chip 22 is shown to have 12 input/output pins, but it will be apparent that a much larger chip may actually be required.

Logic chip 22 is mounted on a printed circuit (PC) board 24. PC board 24 is affixed, such as by gluing, to the upper surface of base 18. As is known, a printed circuit board contains a plurality of traces (not shown) for connecting electronic circuit elements. For example, the pins of logic chip 22, such as pins 28*a* and 28*b*, connect to traces in PC board 24. These traces carry DC power signals or digital logic signals. Additionally, other chips might be mounted on printed circuit board 24. For example, power regulators and other chips might be required.

To connect the traces on PC board 24 to RF packages 16*a* . . . 16*d*, flexible cables used. Flexible cable 32 is shown connecting RF package 16*d* to PC board 24. Other such flexible cables (not shown) are used for connections to RF packages 16*a* . . . 16*c*. As is known, a flexible cable is a flexible plastic material in which conductive traces are embedded. Flexible cable can be purchased commercially from Minco of Minneapolis, Minn.

Printed circuit board 24 also contains a multipin connector 30. DC power signals and logic signals are coupled to PC board 24 through the pins 34*a* . . . 34*d* of multipin connector 30. Here, four pins are explicitly shown, but it will be appreciated that some systems will require many more pins.

RF signals are coupled to or from module 10 through coax connector 36. The outer conductor of coax connector 36 is at ground potential. The inner conductor 38 is connected to a metal trace (not shown) embedded in dielectric 42. One of skill in the art will appreciate that such a connection forms a stripline circuit described below.

RF signals are coupled to RF packages 16*a* . . . 16*d* through stripline circuitry in dielectric 42. As is known, a stripline circuit consists of a conducting strip spaced apart from an upper and lower grounded conductor. Here, conductive strips are disposed in dielectric 42 using known techniques. Dielectric 42 rests on base 18 which is at ground potential, forming the lower ground plane. Dielectric 42 is covered by metal plate 40. Screws, such as screws 44*a* and 44*b* and 44*c* and 44*d*(FIG. 1B), secure plate 40 to base 18. Screws 44*a* and 44*b*, since they conduct, ensure that plate 40 is at ground potential, thereby forming the upper ground plane for the stripline in dielectric 42.

Here, the stripline circuit in dielectric 42 forms a 1×4 in-phase power divider. In this way, the RF signal at coaxial coupler 36 can be. distributed equally to each of the RF packages 16*a* . . . 16*d*. A feedthrough (not shown) of known construction must be employed to couple an RF signal from the stripline in dielectric 42 to any of the RF packages 16*a* . . . 16*d*. Connections to and from the stripline circuit in dielectric 42 can be made in any known manner. For example, a lap joint or hand wiring and ribbon bonding could be used.

RF signals are coupled to antenna elements 14*a* . . . 14*d* from RF packages 16*a* . . . 16*d* through stripline circuits in dielectric 46. Plate 48 serves as the upper ground plane and is secured via screws 50*a* . . . 50*d*.

As part of a system, module 10 is attached to mounting block 12. Pin 54A fits into hole 56A. A second pin (not shown) fits into hole 56B. The pins are secured into holes 56A and 56B, such as by screws, to provide mechanical attachment for module 10. In addition, a tab (FIG. 2, tab 201A) fits into slot 52A. Slot 52A provides additional mechanical support for module 10, but also provides for heat removal in a manner described below.

Electrical connections are made to module 10 through mounting block 12. Coax connector 36 fits into coax receptor 58A to couple RF signals onto module 10. Multipin connector 30 fits into multipin receptor 60A. As described above, DC power logic signals are brought onto module 10 through multipin in connector 30.

The foregoing description has referenced components on upper surface 20A of base 18. However, lower surface 20B of base 18 contains identical circuitry similarly disposed. For example, RF package 16*e* is the image on lowersurface 20B of RF package 16*a* on the upper surface 20A. There are three more RF packages 16*f* . . . 16*h* (FIG. 3) on lower surface 20B corresponding to packages 16*b* . . . 16*d*. Stripline in dielectrics 42B and 46B corresponds to stripline in dielectrics 42 and 48. Plates 40B and 48B serve the same purpose as plates 40 and 48. PC board 24B operates like PC board 24.

In addition, the lower surface 20B of base 18 contains a logic chip (not shown) corresponding to logic chip 22. Likewise, lower surface 20B contains a coax connector and multipin connector corresponding to coax connector 36 and multipin connector 30. The coax connector on lower surface 20B, however, plugs into coax receptor 58B and the multipin connector plugs into multipin receptor 60B.

The apparent duplication of circuitry on the upper and lower surfaces of base 18 can be understood when it is appreciated that antenna elements 14*a*. . . 14*d* are dual polarization elements. Here, the circuitry on upper surface 20A processes the co-polarization signal. The circuitry on lower. surface 20B processes the cross polarization signal. In this way, module 10 can be said to be a four element, dual polarization array.

Figure 2:
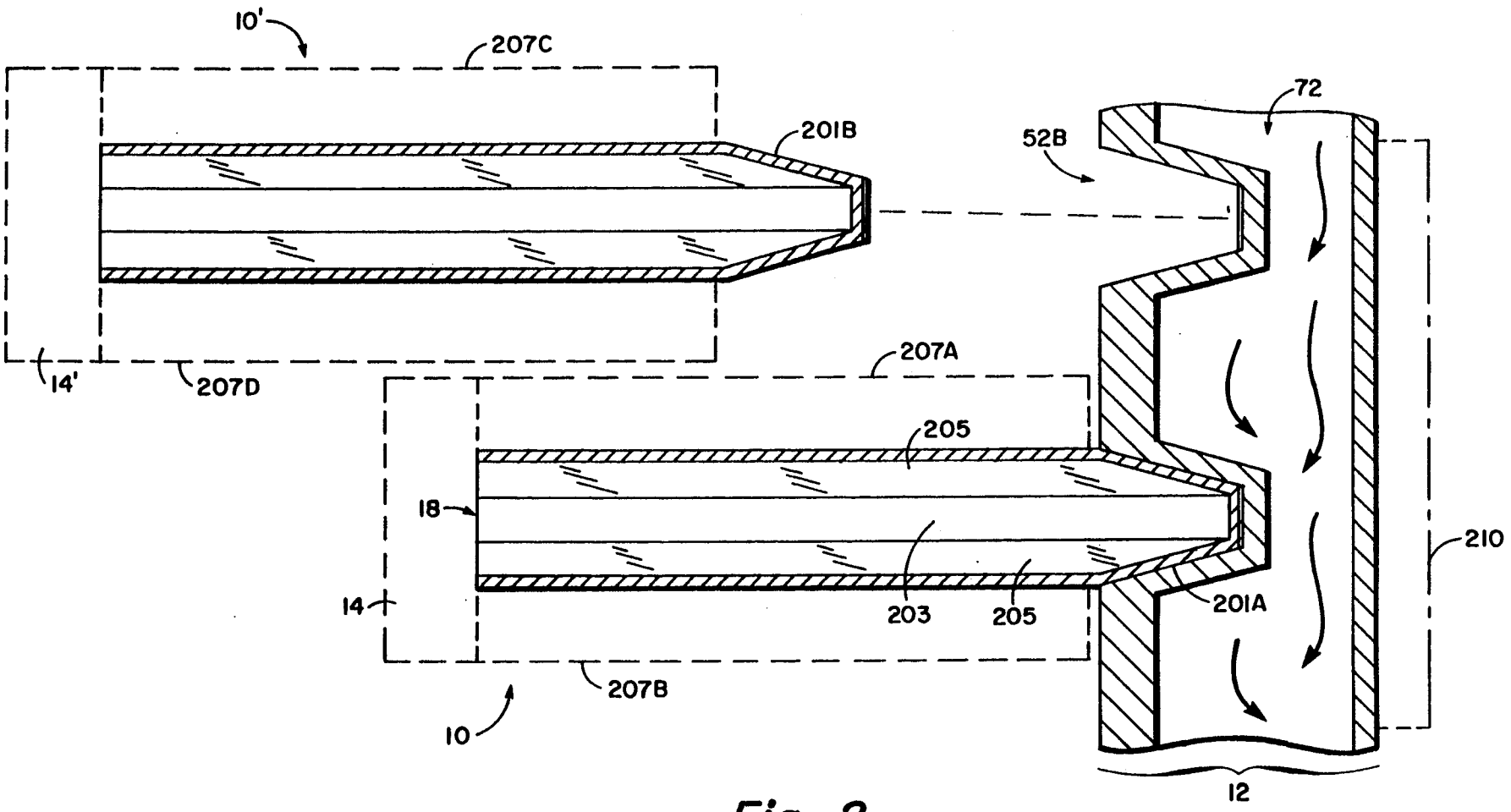
FIG. 2 is a cross-section of the module and mounting block of FIG. 1, taken along the line 2—2.

To make a transmitter with a larger array, like modules can be coupled together. For example, mounting block 12 has holes 56C and 56D, slot 52B, coax receptors 58C and 58D and multipin connectors 60C and 60D, all arranged to receive a module identical to module 10. The second module fits above module 10. For example, FIG. 2 shows in cross-section module 10 mounted in mounting block 12. A second like module 10' could be inserted in slot 52B above module 10. With both modules mounted in mounting block 12, antenna elements 14 (FIG. 2) of module 10 are adjacent to antenna elements 14' of module 10'. The combined modules form a 4×2 element array. With more mounting holes, slots, coax receptors, and multipin receptors in mounting block 12, more modules could be stacked, one on top of another, to make a larger array.

Module 10 has several features which allow modules to be stacked. Module 10 has tabs 62A and 62B on lower surface 20B. Tabs 62C and 62D (FIG. 1B) are located on far side 21B of module 10. A module stacked on top of module 10 would have similar tabs which would fit into slots 64A, 64B, 64C, and 64D. A screw (not shown) passing through holes 70A, 70B, 70C, and 70D in the tabs and slots can be used to secure the modules together.

In forming an array, the spacing between antenna elements impacts the beam pattern produced by the array. The tab and slot arrangement ensures the correct spacing of the modules. It is important to note that the RF packages 16*a*. . . 16*d* extend above upper surface 20A less than antenna elements 14*a*. . . 14*d*. Likewise, RF packages 16*e*. . . 16*h* extend below lower surface 20B less than antenna elements 14*a*. . . 14*d*. Thus, the thickness of electronic components 16*a*. . . 16*h* plus the thickness of base 18 is less than the height of antenna elements 14*a*. . . 14*d*. These thicknesses of RF packages and base 18 ensure that modules can be stacked with the required spacing. It should also be noted that flexible cable 32 is flexible and will lie flat against plate 40 when module 10 is stacked with another module.

Two modules, such as module 10, can be connected horizontally to form an eight element linear array. Here, slots 66A and 66B are adapted to receive tabs. Projections 67A and 67B (FIG. 1B) are adapted to fit in slots such as slots 66A and 66B are located on far side 21B of module 10. The modules are secured by screws in holes 70A and 70B which pass through both the projection and the slot. Here, screws in holes 70A and 70B can secure mcdules when stacked in either the horizontal and vertical directions.

Module 10 also contains a projection 68 and a slot 69 (FIG. 1B) on far side 21B opposite projection 68. When two modules are placed side by side, projection 68 of one module fits into slot 69 (FIG. 1B) of the other module. On module 10, the slot is below RF package 16*d*. Thus, when modules are placed side by side, one RF package on each module is mounted on a projection from another package. This arrangement provides a means of securing the outside RF packages 16*a* and 16*e* since they are located along the seam of two adjacent modules.

One problem of stacking modules containing electronic components is that of heat removal. Each electronic component generates heat and many such components placed close together—such as occurs when electronic components are mounted on both sides of base 18—may generate enough heat to interfere with the operation of the electronics 207A . . . 207D. In FIG. 2, electronics 207A . . . 207D represent the electronic elements on modules 10 and 10'. For example, electronics 207A represent the components in RF packages 16*a*. . . 16*d*, and logic chip 22.

To remove heat, mounting block 12 has a channel 72 in which cooling fluid flows. Here Coolanol, a trademark of monsanto, is used. Slots and 52B project into channel 72 which allow tabs 201A and 201B to also project into channel 72. Tabs 201A and 201B are thus exposed to the cooling fluid, allowing heat transfer from tabs 201A and 201B to the cooling fluid. One of skill in the art will appreciate that only a portion of mounting block 12 is shown. A system would necessarily include some means (not shown) of circulating cooling fluid in channel 72.

Heat is transferred from the electronic components 207A and 207B to tab 201A via heat pipes in base 18. As is known, a heat pipe consists of a vapor channel 203 and a wick 205. Suitable materials for a wick include polypropelene or nylon.

Vapor in vapor channel 203 condenses at the end of the heat pipe near tab 201A due to the cooling effect of the cooling fluid in channel 72. Liquid wicks up wick 205 towards electronics 207A and 207B. Heat from electronics 207A and 207B evaporates the liquid as the liquid absorbs the heat generated by the electronics. The vaporized liquid flows into vapor channel 203. Since vapor condenses near tab 201A, there is a vapor pressure gradient in that direction, causing the vapor to flow towards tab 201A. The cycle of evaporation and condensation repeats, transferring heat from electronics 207A and 207B to cooling fluid in channel 72.

Figure 3:
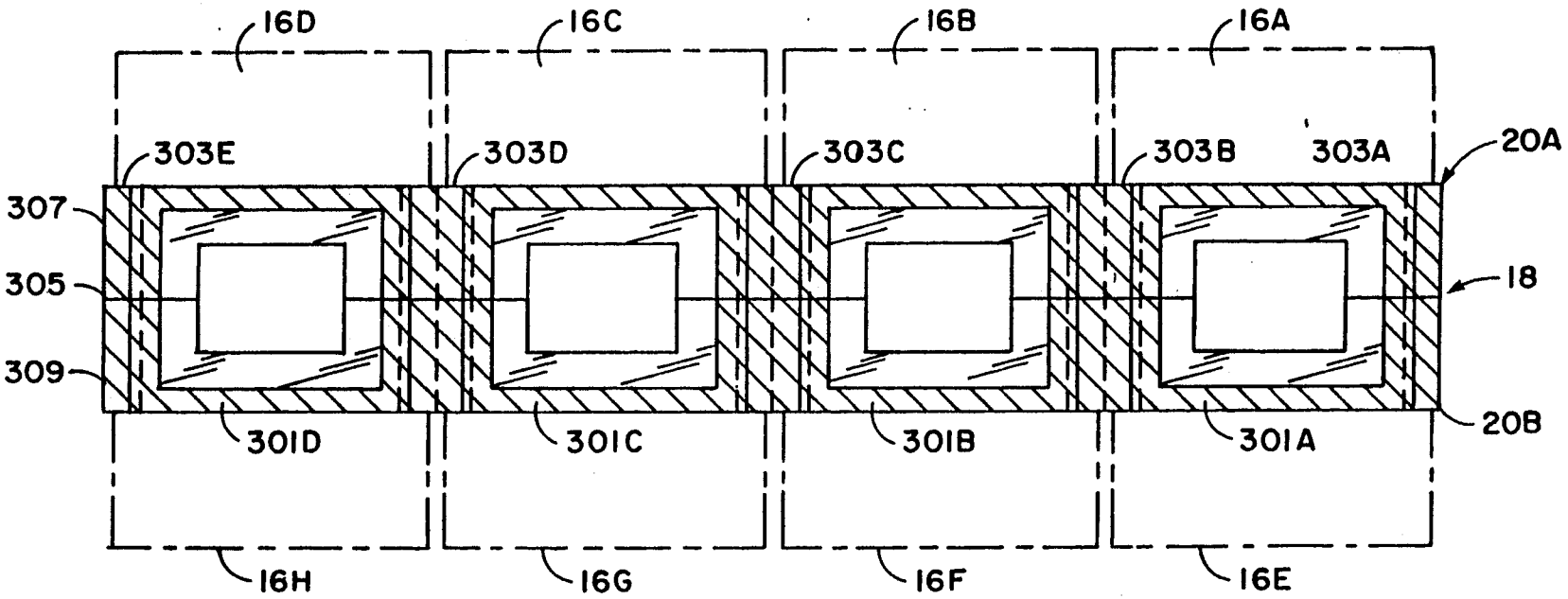
FIG. 3 is a cross-section of the module of FIG. 1 taken along the line 3—3.

FIG. 3 shows more details of the heat pipes inside base 18. FIG. 3 shows a cross-section of module 10 as indicated by line 3—3 in FIG. 1. Here, four heat pipes 301A . . . 301D are used. Each of the heat pipes 301A . . . 301D runs adjacent to one of the RF packages 16A . . . 16D on upper surface 20A of base 18 and one of the packages 16*e*. . . 16*h* on lower surface 20B of base 18.

Heat pipes 301A . . . 301D are separated by spaces 303A . . . 303E. Spaces 303A . . . 303E are adjacent to mounting recesses in packages 16*a*. . . 16*h* such as mounting recesses 26*a*, 26*b*, 26*c*. Screws (not shown) for mounting packages 16*a*. . . 16*d* can be placed in spaces 303A . . . 303E.

FIG. 3 shows additional details of the construction of module 10. Seam 305 is a braze line. When assembling base 18, an upper section 307 and a lower section 309 are joined, such as by brazing, along seam 305.

In operation, electronics 210 (FIG. 2) generate the RF signal to be transmitted and signals, called "beam steering commands", which indicate the direction in which the signal is to be transmitted. One of skill in the art will appreciate that the operation of electronics 210 is dictated by what function the transmitter is to perform. For example, a radar system will generate different types of signals than a radio. Thus, electronics 210 are constructed according to known techniques based on the application of the transmitter constructed from assembled modules.

The RF signal, beam steering commands, and DC bias voltages pass on wires or cables (not shown) through channel 72 to multipin receptors 60A . . . 60D and coax receptors 58A . . . 58D (FIG. 1). Conventional wiring techniques can be used for these connections. It should be noted, though, that the cross-section of the wire in channel 72 should be minimized so as not to impede the flow of cooling fluid in channel 72.

The beam steering commands are applied to logic chip 22 (FIG. 1) via traces on PC board 24 while the RF signals are applied to the microstrip circuitry in dielectric 42. The RF signals are then applied to the inputs of RF packages 16*a*. . . 16*d*.

Control logic 22 processes the beam steering commands and derives phase shifter control signals and gain control signals for each of the phase shifters and amplifiers in RF packages 16*a*. . . 16*d*. At the appropriate time, control logic in control chip 22 applies the phase shifter control signals and gain control signals on its output pins (only two of which are 28B and 28C). The signals are coupled via traces on PC board 24 and flexible cables, such as flexible cable 32, to control inputs of RF packages 16*a*. . . 16*d*.

The RF circuitry in RF packages 16*a*. . . 16*d* uses known techniques to amplify and shift the phase of the RF signals applied to them. These RF signals then pass through the stripline circuitry in dielectric 46 to antenna elements 14*a*. . . 14*d* where they are transmitted as the co-polarization signal.

At the same time as signals are applied to electronic components on upper surface 20A, signals are applied to the electronic components on lower surface 20B. These signals produce the cross polarization signal transmitted by antennas 14*a*. . . 14*d*.

Where many modules are connected to form a transmitter, control signals would be applied to all of them. In that case, electronics 210 (FIG. 2) must contain circuitry which applies the correct signals to the correct modules.

Having described one embodiment of the invention, it is apparent that various alternative embodiments can be constructed. For example, module 10 is shown to contain four antenna elements, but more or fewer elements could be used. A dual polarization system is described, but a single polarization system could just as easily be constructed. Also, the description here was limited to a transmitter module, but the invention could be applied to a receiver, a transmitter/receiver module, or other type of radio frequency system. Further, a specifib heat removal mechanism was described. Other heat removal mechanisms could be used. Alternatively, the disclosed heat removal mechanism could be used for modules containing any type of electronics without being limited to a transmit module. It is felt, therefore, that this invention should be limited only by the spirit and scope of the appended claims.

What is claimed is:

1. A radio frequency system of the type having an array antenna, said system comprising:

a) a plurality of modules, each module comprising:
   (i) a supporting base, having a frontal edge, a rearward edge, and a surface disposed between said frontal edge and said rearward edge;
   (ii) a plurality of antenna elements mounted along said frontal edge of the supporting base; and
   (iii) a plurality of RF packages mounted on said surface of the supporting base, each such RF package having an RF signal port electrically coupled to a different one of the plurality of antenna elements; and b) means for mounting the plurality of modules along the rearward edge of each of the plurality of modules with the plurality of antenna elements of each of the plurality of modules arranged to from the array antenna of the system.

2. The radio frequency system of claim 1 wherein each RF package comprises, electrically coupled to its RF signal port, a) an amplifier for radio frequency signals; and b) a phase shifter, connected in series with the amplifier.

3. The radio frequency system of claim 2 wherein each of the plurality of modules additionally comprises an integrated circuit chip, mounted over the supporting base thereof, said chip representing logic circuitry for generating control signals to the amplifier and phase shifter in each of the plurality of RF packages.

4. The radio frequency system of claim 3 wherein each of the plurality of modules additionally comprises a printed circuit board mounted to the first surface of the supporting base thereof and wherein the integrated circuit chip is mounted on the printed circuit board.

5. The radio frequency system of claim 4 additionally comprises:

a) control electronics; and b) means for electrically connecting the control electronics to the integrated circuit chip of each of the plurality of modules, said means passing through the mounting means.

6. The radio frequency system of claim 5 wherein the mounting means comprises a channel for carrying cooling fluid.

7. The radio frequency system of claim 6 including means for thermally coupling each of the plurality of modules to the channel.

8. The radio frequency system of claim 6 wherein the mounting means comprises a plurality of slots, each slot being bounded by walls projecting into the channel.

9. The radio frequency system of claim 8 wherein the supporting base of each of the plurality of modules comprises a fin which projects into a corresponding one of said plurality of slots.

10. The radio frequency system of claim 9 wherein the supporting base of each of the plurality of modules comprises at least one heat pipe, one end of said at least one heat pipe being disposed in the fin.

11. The radio frequency system of claim 10 wherein the at least one heat pipe is disposed adjacent one of the plurality of RF packages.

12. The radio frequency system of claim 1 additionally comprising a plurality of heat pipes disposed in the supporting base of each of the plurality of modules.

13. The radio frequency system of claim 12 wherein each of the plurality heat pipes is disposed adjacent one of the plurality of RF packages.

14. The radio frequency system of claim 13 wherein the mounting means comprises means for dissipating heat and including means for thermally coupling each of the plurality of heat pipes to the means for dissipating heat.

15. The antenna recited in claim 2 wherein each one of the plurality of antenna elements of each one of the plurality of modules has a co-polarization input and a cross-polarization input and wherein the plurality of RF packages mounted on said surface are coupled to the co-polarization inputs.

16. The antenna recited in claim 15 wherein each one of the modules includes a second plurality of RF packages mounted on a second surface of the supporting base, such second plurality of RF packages being coupled to the cross-polarization inputs.

17. The radio frequency system of claim 2 wherein each of the plurality of modules additionally comprises:

a) a dielectric layer having stripline circuitry disposed thereon, said dielectric layer being mounted on the first surface of the supporting base thereof between the plurality of RF packages and the plurality of antenna elements, said stripline circuitry being electrically connected to the plurality of RF packages and the plurality of antenna elements.

18. An electronic system comprising:

a) a plurality of modules, each module comprising:
   (i) a supporting base having a fin disposed along one edge;

(ii) at least one package of electronics mounted on the supporting base; and (iii) at least one heat pipe, comprising a vapor channel and wick, disposed in the supporting base, said at least one heat pipe having an end disposed in the fin; and b) means, having a heat removing channel and a plurality of slots formed therein, for mounting said plurality of modules, said mounting means comprising:

(i) means for dissipating heat, said means being disposed in the heat removing channel of the mounting means, and wherein the fin of each module projects into a corresponding one of the plurality of slots and is in thermal contact with the means for dissipating heat.

19. The electronic system of claim 18 wherein the means for dissipating heat comprises a refrigerated fluid.

20. The electronic system of claim 19 wherein the mounting means additionally comprises means for coupling electrical signals to said at least one package of electronics of each of the plurality of modules, said coupling means passing through the the heat removing channel of the mounting means.

21. The electronic system of claim 20 wherein each of the plurality of modules comprises a plurality of packages of electronics, wherein the supporting base of each of the plurality of modules comprises two sides, and wherein a first portion of said plurality of packages of electronics is mounted on a first one of said two sides and a second portion of said plurality of packages of electronics is mounted on a second one of said two sides.

22. The electronic system of claim 21 wherein each of the plurality of modules comprises one heat pipe for each one of said first portion of said plurality of packages of electronics and wherein said one heat pipe is disposed adjacent to said one of said plurality of packages.

23. The electronic system of claim 22 wherein each of said plurality of packages of electronics comprises Monolithic Microwave Integrated Circuits (MMIC).

24. The electronic system of claim 23 wherein each of said plurality of packages of electronics comprises:

a) an RF input port;

b) an amplifier; and c) a phase shifter, said amplifier and said phase shifter being connected in series with the RF input port.

* * * * *